US006986651B2

(12) United States Patent
Whisenant et al.

(10) Patent No.: US 6,986,651 B2
(45) Date of Patent: Jan. 17, 2006

(54) PUMP PRIMING APPARATUS

(75) Inventors: Claude R. Whisenant, Fairview, NC (US); Rodney W. Burnette, Asheville, NC (US)

(73) Assignee: Balcrank Products, Inc., Weaverville, NC (US)

( * ) Notice: Subject to any disclaimer, the term of this patent is extended or adjusted under 35 U.S.C. 154(b) by 94 days.

(21) Appl. No.: 10/166,516

(22) Filed: Jun. 10, 2002

(65) Prior Publication Data

US 2003/0228228 A1 Dec. 11, 2003

(51) Int. Cl.
*F04B 7/04* (2006.01)

(52) U.S. Cl. ..... 417/489; 417/53; 417/460; 417/490; 417/545; 417/555.1; 417/448; 92/162 R

(58) Field of Classification Search ..... 417/53, 417/199.2, 460, 469, 489, 490, 545, 550, 417/448, 555.1, 555.2; 92/162 R
See application file for complete search history.

(56) References Cited

U.S. PATENT DOCUMENTS

| | | | | | |
|---|---|---|---|---|---|
| 640,324 | A | * | 1/1900 | Sample | 417/328 |
| 1,382,705 | A | * | 6/1921 | Wood | 417/489 |
| 1,493,727 | A | * | 5/1924 | Bennett | 222/372 |
| 2,168,729 | A | * | 8/1939 | Cavins | 166/110 |
| 2,435,527 | A | * | 2/1948 | Arpin | 222/79 |
| 2,655,287 | A | * | 10/1953 | Campbell | 222/255 |
| 2,665,645 | A | * | 1/1954 | Wells | 166/105 |
| 3,153,385 | A | * | 10/1964 | Bowen, Jr. | 417/490 |
| 4,047,854 | A | * | 9/1977 | Penn | 417/489 |
| 4,249,868 | A | * | 2/1981 | Kotyk | 417/511 |
| 4,515,180 | A | | 5/1985 | Napolitano | |
| 4,591,315 | A | | 5/1986 | Vadasz Fekete | |
| 4,684,333 | A | | 8/1987 | Hirakawa et al. | |
| 4,708,597 | A | | 11/1987 | Fekete | |
| 4,740,141 | A | | 4/1988 | Fekete | |
| 4,758,131 | A | | 7/1988 | Gurney | |
| 4,875,833 | A | | 10/1989 | Canaud et al. | |
| 5,067,882 | A | * | 11/1991 | DeVries et al. | 417/511 |
| 5,147,188 | A | | 9/1992 | Shaefer | |
| 5,343,982 | A | | 9/1994 | Min | |
| 5,407,332 | A | * | 4/1995 | Yedinak et al. | 417/489 |
| 5,533,879 | A | * | 7/1996 | Chen | 417/553 |
| 5,605,446 | A | * | 2/1997 | Handzel et al. | 417/262 |
| 5,616,014 | A | | 4/1997 | Tsai | |
| 6,299,419 | B1 | * | 10/2001 | Hunklinger et al. | 417/490 |

* cited by examiner

*Primary Examiner*—Cheryl Tyler
*Assistant Examiner*—Emmanuel Sayoc
(74) *Attorney, Agent, or Firm*—Carter Schnedler & Monteith, P.A.

(57) ABSTRACT

A pump priming apparatus including a housing through which fluid object material may be urged to flow, the housing including an intake portion and a pumping portion downstream from the intake portion. The apparatus further includes a piston assembly carried for reciprocation in the housing, the piston assembly and the housing being configured such that a partial vacuum is developed in the pumping portion of the housing as the piston assembly moves through the pumping portion of the housing toward the intake portion of the housing and such that the partial vacuum is substantially released upon the movement of the piston assembly into the intake portion of the housing, thereby causing the fluid object material in the intake portion of the housing to flow into the pumping portion of the housing.

14 Claims, 5 Drawing Sheets

PUMP PRIMING APPARATUS

BACKGROUND OF THE INVENTION

In order to remove fluid material from a container of such material, and particularly in the event that the container of fluid material contains substantially more fluid material than is needed at any given point in time, the fluid material is typically pumped out of the container in the desired quantity. This holds true for a variety of fluid materials, including but not limited to highly viscous lubricating fluids such as high viscosity grease. However, in order to pump such materials from a container, the material must first be drawn into the pumping device. This initial drawing in of material into the pumping device is referred to by those of ordinary skill in the art as "priming" the pump. In sum, in order for a pump to effectively remove fluid from a container, the pump must first be primed. When the fluid material is highly viscous, the sheer inertia of the still fluid is substantial and such inertia must be overcome in order to prime the pump. Therefore, to prime a pump with highly viscous fluid, the priming mechanism of the pump must impart enhanced force on the fluid.

Prior art pump priming mechanisms address the problem of priming pumps with highly viscous fluid materials in a variety of ways. One such way is the creation of a partial vacuum which is then released, causing a sudden equalization of air pressure that urges the high viscosity material into the pump. As used herein, the term "partial vacuum" means an air pressure lower than an ambient air pressure.

One prior art example of the utilization of sudden release of a partial vacuum for pump priming is U.S. Pat. No. 4,249,868 to Kotyk. The Kotyk patent discloses a pump with a priming mechanism designed to address the problem of pumping high viscosity material. In the Kotyk pump, the piston travels within a cylindrical valve, which in turn travels within the pump cylinder. When the piston completes a downstroke, the cylindrical valve blocks the inlet of the pump. On the upstroke, the piston creates a partial vacuum within the cylindrical valve until the piston reaches the top of the cylindrical valve and lifts the valve such that the inlet is reopened. Upon the reopening of the inlet, the partial vacuum in the cylindrical valve is released and the sudden equalization of pressure causes the fluid material at the inlet to rush into the cylindrical valve before proceeding into the succeeding stages of the pump.

In contrast to Kotyk and other partial vacuum priming devices in the prior art, the pump priming apparatus of the present invention provides a simple piston and cylinder structure to accomplish the priming without the need for additional parts that ultimately add expense to the construction and maintenance of the pump while diminishing its reliability.

SUMMARY OF THE INVENTION

One embodiment of the invention is a pump priming apparatus including a housing through which fluid object material may be urged to flow, the housing including an intake portion and a pumping portion downstream from the intake portion. This apparatus embodiment of the invention further includes a piston assembly carried for reciprocation in the housing, the piston assembly and the housing being configured such that a partial vacuum is developed in the pumping portion of the housing as the piston assembly moves through the pumping portion of the housing toward the intake portion of the housing and such that the partial vacuum is substantially released upon the movement of the piston assembly into the intake portion of the housing, thereby causing the fluid object material in the intake portion of the housing to flow into the pumping portion of the housing.

Another embodiment of the invention is a method of priming a pump for pumping fluid object material, the method including the steps of providing a pump priming apparatus comprising a housing through which fluid object material may be urged to flow, the housing including an intake portion and a pumping portion downstream from the intake portion. Additional steps of this method embodiment of the invention include placing the intake portion of the housing in the fluid object material to be pumped, creating a partial vacuum in the pumping portion of the housing, substantially releasing the partial vacuum in the pumping portion of the housing, thereby causing the fluid object material to flow from the intake portion of the housing into the pumping portion of the housing, and pumping the fluid object material out of the pumping portion of the housing.

Yet another embodiment of the invention is a pump priming apparatus including means for carrying a flow of fluid object material therethrough, the carrying means including an intake portion and a pumping portion downstream from the intake portion. This apparatus embodiment of the invention further includes means for urging the fluid object material through the carrying means, the urging means and the carrying means being configured such that a partial vacuum is developed in the pumping portion of the carrying means as the urging means moves through the pumping portion of the carrying means toward the intake portion of the carrying means, and such that the partial vacuum is substantially released upon the movement of the urging means into the intake portion of the carrying means, thereby causing the fluid object material in the intake portion of the carrying means to flow into the pumping portion of the carrying means.

Yet another embodiment of the invention is a method of priming a pump for pumping fluid object material, the method including the steps of providing a pump priming apparatus comprising a means for carrying a flow of fluid object material therethrough, said carrying means comprising an intake portion and a pumping portion downstream from the intake portion. Additional steps of this method embodiment of the invention include placing the intake portion of the carrying means in the fluid object material to be pumped, creating a partial vacuum in the pumping portion of the carrying means, substantially releasing the partial vacuum in the pumping portion of the carrying means, thereby causing the fluid object material to flow from the intake portion of the carrying means into the pumping portion of the carrying means, and pumping the fluid object material out of the pumping portion of the carrying means.

BRIEF DESCRIPTION OF THE DRAWINGS

The present disclosure may be better understood when taken in conjunction with the accompanying drawings, in which.

DETAILED DESCRIPTION

Figure 1:
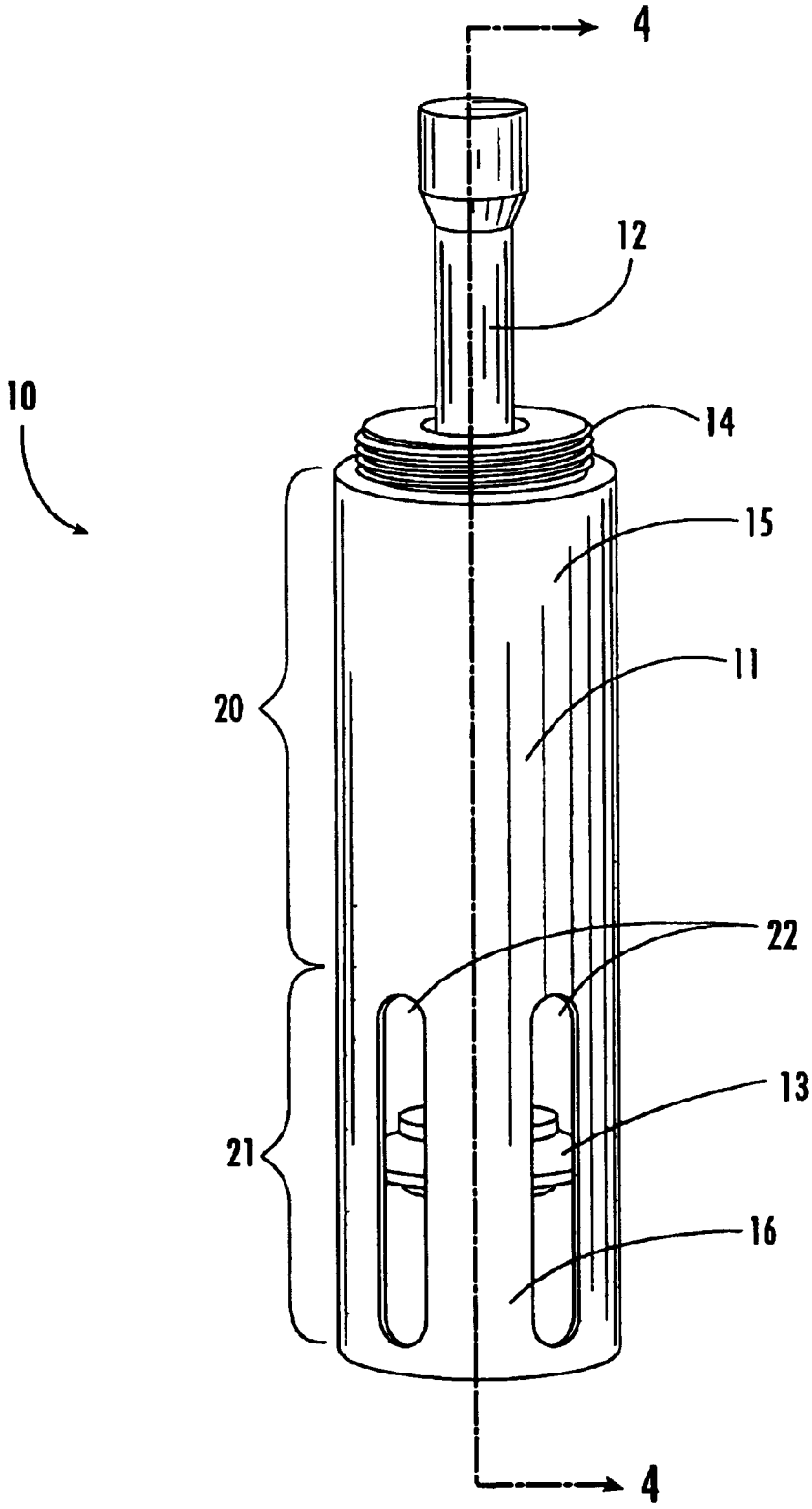
FIG. 1 is a perspective view of a pump priming apparatus according to an embodiment of the invention.

Referring now to the drawings, FIG. 1 illustrates a pump priming apparatus 10 according to an embodiment of the present invention. The basic components of the pump priming apparatus 10 are the cylinder 11, the piston rod 12, and the piston 13. The piston 13 is carried on one end of the piston rod 12, which reciprocates in the cylinder 11 during operation of the pump priming apparatus 10. The cylinder 11 is provided with a threaded portion 14 for interfacing with an adjacent section of the pump (not shown). The cylinder 11 has a proximal end 15 and a distal end 16; the proximal end 15 includes the threaded portion 14 of the cylinder 11. A pumping portion 20 of the cylinder 11 is adjacent to the proximal end of the cylinder 11, while an inlet portion 21 of the cylinder 11 is adjacent to the distal end 16 of the cylinder 11. The inlet portion 21 defines a plurality of inlet ports 22 for allowing fluid material (not shown) to flow into the cylinder 11. The inlet ports 22 allow the fluid material to flow into the cylinder 11 when the distal end 16 of the cylinder 11 is resting on the bottom of a container (not shown) of fluid material.

Figure 2:
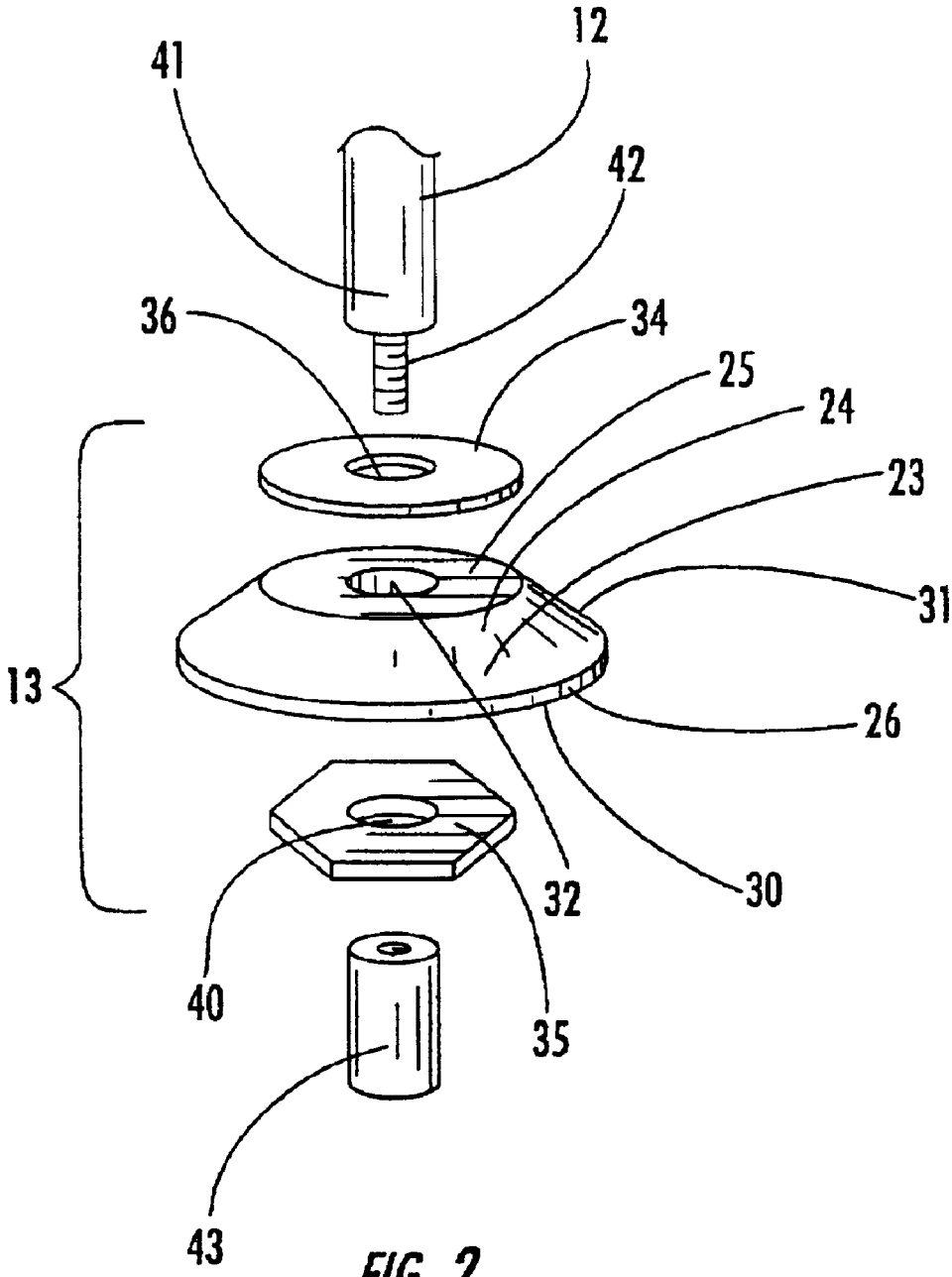
FIG. 2 is an exploded view of a piston according to an embodiment of the invention.
Figure 3:
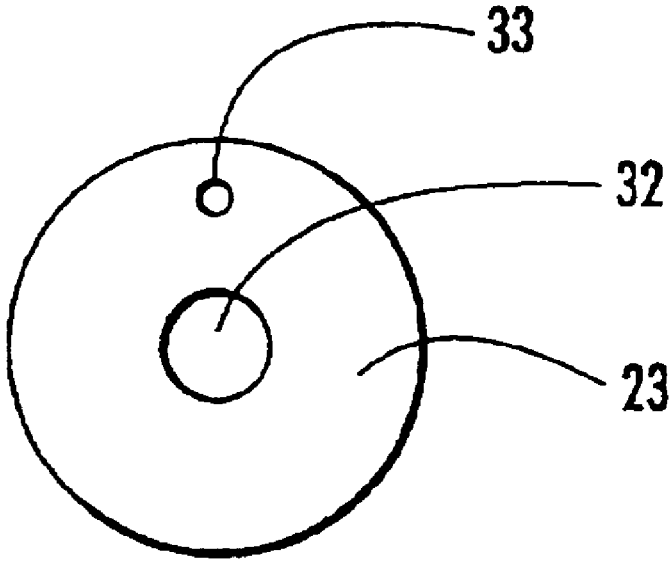
FIG. 3 is a bottom plan view of a valve according to an embodiment of the invention.
Figure 4:
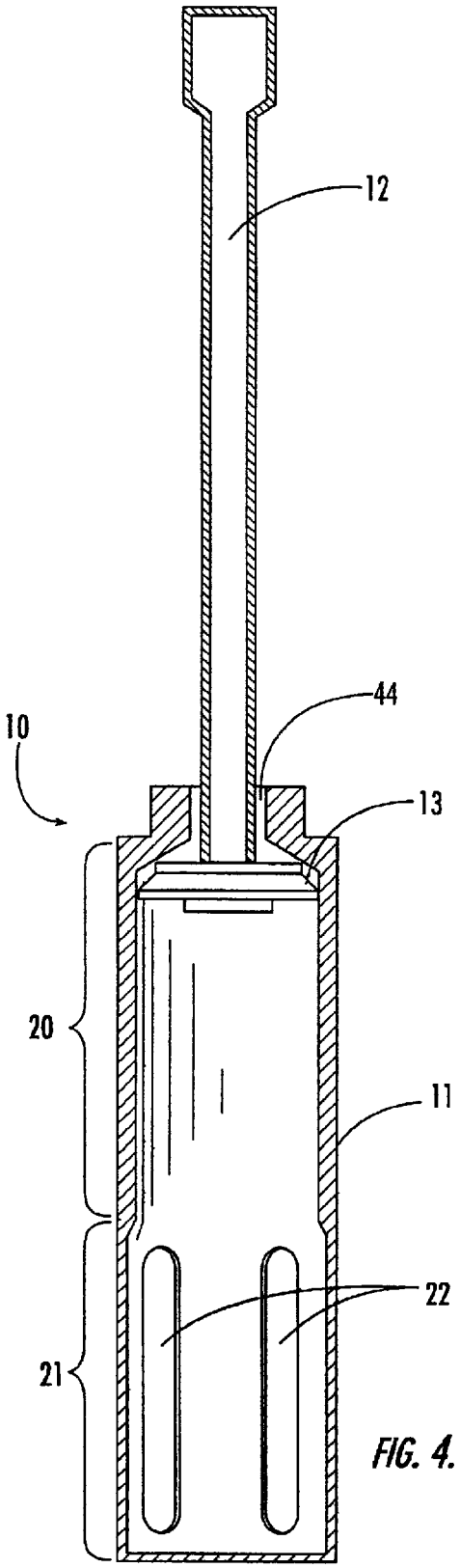
FIGS. 4, 5, 6, and 7 are cross-sectional views of the pump priming apparatus of FIG. 1 taken through line 4—4 in FIG. 1, illustrating four positions successively occupied by an embodiment of a piston according to the invention during one full downstroke of the piston in the cylinder.
Figure 5:
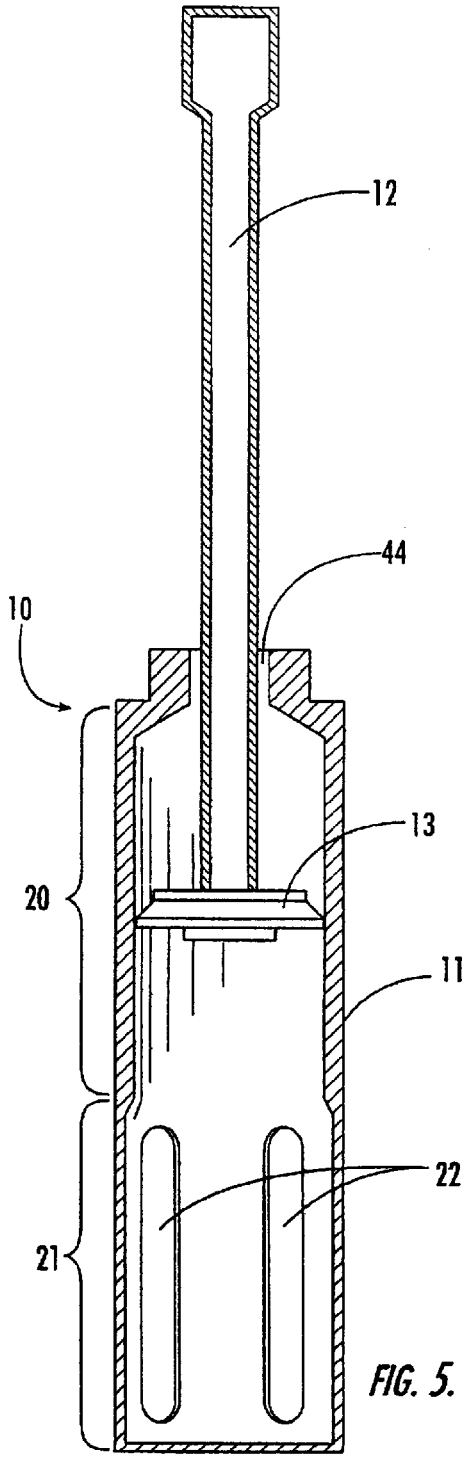
Figure 6:
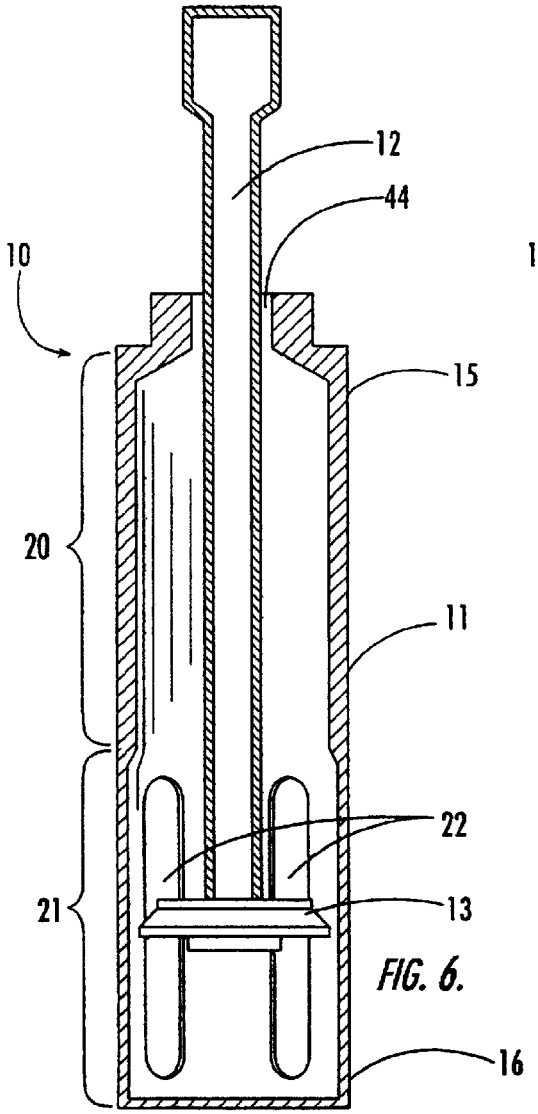
Figure 7:
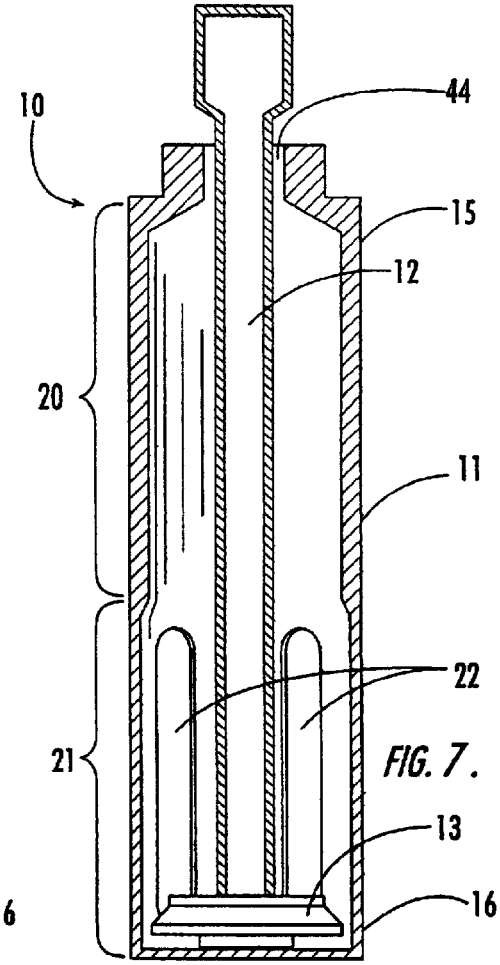

Turning now to FIG. 2, the construction of the piston 13 is shown. A disc valve 23 comprises the central portion of the piston 13. The disc valve 23 includes a upper valve portion 24 having a upper major valve surface 25 facing toward the piston rod 12 and a lower valve portion 26 having a lower major valve surface 30 facing away from the piston rod 12. A chamfer 31 sloping radially outward from the periphery of the upper valve portion 24 to the periphery of the lower valve portion 26 results in the diameter of the upper valve portion 24 being smaller than the diameter of the lower valve portion 26. The valve 23 defines a centrally disposed port 32 that enables the fastening of the valve 23 as part of the piston 13. Furthermore, as shown in FIG. 3, the valve 23 defines a weep hole 33 for preventing the piston 13 from seizing in the cylinder 11, as described further below.

Turning back to FIG. 2, the piston 13 further includes a washer 34 and a hexagonal nut 35, which engage the upper and lower major valve surfaces 25, 30, respectively, when the piston 13 is fully assembled. The washer 34 and the nut 35 each define respective centrally disposed ports 36, 40 that align with the centrally disposed port 32 defined by the valve 23 when the piston 13 is assembled.

Still referring to FIG. 2, the piston 13 is fastened to the piston rod 12 as follows. A piston-engaging end 41 of the piston rod 12 carries a threaded bolt shank 42. An internally threaded sleeve 43 is provided for receiving the bolt shank 42. The bolt shank 42 and the sleeve 43 are screwed together and carry the piston 13 by insertion through the centrally disposed ports 32, 36, 40 of the valve 23, the washer 34, and the nut 35 of the piston 13.

Turning now to FIGS. 4, 5, 6, and 7, the piston rod 12, the piston 13, and the interior of the cylinder 11 are more visible and four successive stages of one complete downstroke of the piston 13 are shown. It can be seen from these drawings that the inner diameter of the pumping portion 20 of the cylinder 11 is smaller than the inner diameter of the inlet portion 21 of the cylinder 11. This variance in the inner diameter of the cylinder 11 is directly related to the outer diameter of the piston 13. Specifically, the outer diameter of the piston 13 is nearly equal to the inner diameter of the pumping portion 20 of the cylinder 11, but is smaller than the inner diameter of the inlet portion 21 of the cylinder 11.

This variation in the inner diameter of the cylinder 11 and its relation to the outer diameter of the piston 13 enables a pressure differential and equalization to occur during the movement of the piston 13 in the cylinder 11. As the piston 13 moves on a downstroke beginning from the proximal end 15 of the cylinder (FIG. 4) through the pumping portion 20 of the cylinder 11 (FIG. 5), a partial vacuum is developed in the pumping portion 20 of the cylinder 11. As the piston 13 continues its downstroke toward the distal end 16 of the cylinder 11 by moving into the inlet portion 21 of the cylinder 11 (FIG. 6), the partial vacuum in the pumping portion 20 of the cylinder 11 is substantially released and the pressures in the pumping portion 20 and the inlet portion 21 suddenly equalize, forcing the fluid material in or near the inlet portion 21 of the cylinder 11 to be drawn into the pumping portion 22 of the cylinder 11.

The weep hole 33 (FIG. 3) defined by the valve 23 allows a small amount of air and/or fluid material in the cylinder 11 to flow back and forth between the pumping portion 20 and the inlet portion 21 of the cylinder 11 (FIGS. 4,5,6,7) as the piston 13 moves within the cylinder 11. This small air and/or fluid material flow helps prevent the partial vacuum created in the cylinder 11 during operation of the apparatus 10 from becoming so strong as to cause the piston 13 to be immobilized in the cylinder 11. However, the flow enabled by the weep hole 33 does not detract from the above-described priming action of the apparatus 10.

After the piston 13 reaches the distal end 16 of the cylinder 11 to complete its downstroke (FIG. 7), the piston 13 begins its upstroke in the cylinder 11 by traveling back toward the proximal end 15 of the cylinder 11. The order of the piston positions discussed above and shown in FIGS. 4, 5, 6, and 7 need only be reversed to view various stages of the upstroke motion of the piston 13. On its upstroke, the piston 13 forces the fluid material in the cylinder 11, and especially the fluid material in the pumping portion 20 of the cylinder 11, out of the cylinder 11 through an opening 44 in the proximal end 15 of the cylinder 11 and into an adjacent section of the pump (not shown).

Although the above description and the accompanying drawings describe embodiments of the cylinder, piston, and valve of the present invention that are cylindrical and/or annular in shape, similar results may be achieved with elements of varying shapes, so long as the seal between the valve on the piston and the pumping portion of the pump priming apparatus is sufficient to create the desired partial vacuum in the pump priming apparatus and so long as the partial vacuum may be released to cause the flow of fluid material into the pump priming apparatus. Similarly, the composition of the various elements of the pump priming apparatus may also vary so long as the necessary functions of those elements are still served.

A pump priming apparatus is described above. Various details of the invention may be changed without departing from its scope. Furthermore, the foregoing description of the invention and the best mode for practicing the invention are provided for the purpose of illustration only and not for the purpose of limitation—the invention being defined by the claims.

What is claimed is:

1. A pump priming apparatus, comprising:

a housing through which fluid object material may be urged to flow, said housing including an intake portion and a pumping portion downstream from the intake portion, wherein an inner periphery of the intake portion of the housing is larger than an inner periphery of the pumping portion of the housing;

a piston assembly carried for reciprocation in the housing, said piston assembly comprising a piston mounted on a piston rod, said piston comprising a valve that defines a weep hole for helping to prevent undesired immobilization of the piston assembly in the housing;

said housing and said piston rod defining an opening through which the fluid object material may flow out of the housing;

said piston assembly and said housing being configured such that:

a partial vacuum is developed in the pumping portion of the housing as the piston assembly moves through the pumping portion of the housing toward the intake portion of the housing; and said partial vacuum is substantially released upon the movement of the piston assembly into the intake portion of the housing, thereby causing the fluid object material in the intake portion of the housing to flow into the pumping portion of the housing.

2. A pump priming apparatus according to claim 1, wherein said valve forms a substantial seal with the inner periphery of the pumping portion of the housing when the valve moves through the pumping portion of the housing.

3. A pump priming apparatus according to claim 1, wherein said housing is cylindrical and said piston and said valve are annular.

4. A pump priming apparatus according to claim 1, wherein an end of the piston rod proximal to the piston terminates in a threaded screw shank.

5. A pump priming apparatus according to claim 4, wherein the piston is fastened to the piston rod by a sheath that receives the threaded screw shank.

6. A pump priming apparatus according to claim 5, wherein said piston further comprises a washer and a nut positioned on opposing sides of said valve, said washer, said valve, and said nut being provided with substantially aligned, centrally-disposed holes for carrying the screw-receiving sheath therethrough to mount the washer, the valve, and the nut on the screw shank of the piston rod.

7. A method of priming a pump for pumping fluid object material, said method comprising:

providing a pump priming apparatus comprising a housing through which fluid object material may be urged to flow, said housing comprising an intake portion and a pumping portion downstream from the intake portion, wherein an inner periphery of the intake portion of the housing is larger than an inner periphery of the pumping portion of the housing, a piston assembly carried for reciprocation in the housing, said piston assembly comprising a piston mounted on a piston rod, said piston comprising a valve that defines a weep hole for helping to prevent undesired immobilization of the piston assembly in the housing, and said housing and said piston rod defining an opening through which the fluid object material may flow out of the housing;

placing the intake portion of the housing in the fluid object material to be pumped;

creating a partial vacuum in the pumping portion of the housing;

substantially releasing the partial vacuum in the pumping portion of the housing upon movement of the piston assembly into the intake portion of the housing, thereby causing the fluid object material to flow from the intake portion of the housing into the pumping portion of the housing; and pumping the fluid object material out of the pumping portion of the housing.

8. A pump priming apparatus, comprising:

means for carrying a flow of fluid object material therethrough, said carrying means including an intake portion and a pumping portion downstream from the intake portion, wherein an inner periphery of the intake portion of the carrying means is larger than an inner periphery of the pumping portion of the carrying means;

means for urging the fluid object material through the carrying means, said urging means comprising a piston mounted on a piston rod, said piston comprising a valve that defines a weep hole for helping to prevent undesired immobilization of the urging means in the carrying means;

said carrying means and said piston rod defining an opening through which the fluid object material may flow out of the carrying means;

said urging means and said carrying means being configured such that:

a partial vacuum is developed in the pumping portion of the carrying means as the urging means moves through the pumping portion of the carrying means toward the intake portion of the carrying means; and said partial vacuum is substantially released upon the movement of the urging means into the intake portion of the carrying means, thereby causing the fluid object material in the intake portion of the carrying means to flow into the pumping portion of the carrying means.

9. A pump priming apparatus according to claim 8, wherein said valve forms a substantial seal with the inner periphery of the pumping portion of the carrying means when the valve moves through the pumping portion of the carrying means.

10. A pump priming apparatus according to claim 8, wherein said carrying means is cylindrical and said piston and said valve are annular.

11. A pump priming apparatus according to claim 8, wherein an end of the piston rod proximal to the piston terminates in a threaded screw shank.

12. A pump priming apparatus according to claim 11, wherein the piston is fastened to the piston rod by a sheath that receives the threaded screw shank.

13. A pump priming apparatus according to claim 12, wherein said piston further comprises a washer and a nut positioned on opposing sides of said valve, said washer, said valve, and said nut being provided with substantially aligned, centrally-disposed holes for carrying the screw-receiving sheath therethrough to mount the washer, the valve, and the nut on the screw shank of the piston rod.

14. A method of priming a pump for pumping fluid object material, said method comprising:

providing a pump priming apparatus comprising means for carrying a flow of fluid object material therethrough, said carrying means comprising an intake portion and a pumping portion downstream from the intake portion, wherein an inner periphery of the intake portion of the carrying means is larger than an inner periphery of the pumping portion of the carrying means, means for urging the fluid object material through the carrying means, said urging means comprising a piston mounted on a piston rod, said piston comprising a valve that defines a weep hole for helping to prevent undesired immobilization of the urging means in the carrying means, and said carrying means and said piston rod defining an opening through which the fluid object material may flow out of the carrying means;

placing the intake portion of the carrying means in the fluid object material to be pumped;

creating a partial vacuum in the pumping portion of the carrying means;

substantially releasing the partial vacuum in the pumping portion of the carrying means upon movement of the urging means into the intake portion of the carrying means, thereby causing the fluid object material to flow from the intake portion of the carrying means into the pumping portion of the carrying means; and pumping the fluid object material out of the pumping portion of the carrying means.

* * * * *